US006129959A

United States Patent [19]

Mercer et al.

[11] Patent Number: 6,129,959

[45] Date of Patent: Oct. 10, 2000

[54] SLEEVE LABEL WITH INTEGRAL FLAP AND/OR HEADER

[75] Inventors: Joseph B. Mercer, Hickory; Quy Thai, Conover, both of N.C.

[73] Assignee: Plastic Packaging, Inc., Hickory, N.C.

[21] Appl. No.: 09/006,671

[22] Filed: Jan. 13, 1998

[51] Int. Cl.[7] ..... B65D 5/50; B65B 21/24; B65B 51/04; B65B 53/02

[52] U.S. Cl. ..... 428/35.5; 428/36.9; 428/36.92; 428/43; 428/521; 283/51; 283/56; 283/62; 283/105; 40/310; 40/321; 40/323; 40/324; 40/334

[58] Field of Search ..... 428/36.9, 36.92, 428/521, 41.9, 42.2, 43, 36.91, 35.2, 35.5; 156/86; 53/585; 40/306, 310, 334; 283/51, 56, 81, 94, 98, 99, 100, 101, 104, 105, 62; 229/70

[56] References Cited

U.S. PATENT DOCUMENTS

| | | | |
|---|---|---|---|
| 577,804 | 2/1897 | Wittemann | 40/306 |
| 2,091,346 | 4/1937 | Wright | 40/4 |
| 2,420,045 | 5/1947 | Krug | 40/2 |
| 3,702,511 | 11/1972 | Miller | 40/306 |
| 4,312,523 | 1/1982 | Haines | 283/18 |
| 4,325,762 | 4/1982 | Burmeister et al. | 156/86 |
| 4,446,616 | 5/1984 | Waterman | 29/775 |
| 5,207,458 | 5/1993 | Treichel et al. | 283/81 |
| 5,241,763 | 9/1993 | Hubbs et al. | 29/775 |
| 5,422,152 | 6/1995 | Langeland et al. | 428/36.9 |
| 5,575,096 | 11/1996 | Allegre | 40/306 |
| 5,658,015 | 8/1997 | Allegre | 283/70 |

FOREIGN PATENT DOCUMENTS

| | | |
|---|---|---|
| 755867A1 | 1/1997 | European Pat. Off. . |
| 1043230 | 11/1953 | France . |
| 2682320 | 4/1993 | France . |
| 2699716 | 8/1994 | France . |
| 3924790A1 | 2/1991 | Germany . |
| 2029369 | 8/1978 | United Kingdom . |

OTHER PUBLICATIONS

Derwent Abstract of EP 755867; Fresnel; Thermo–Retractable Packaging Sleeve, Jan. 29, 1997.

*Primary Examiner*—Ellis Robinson
*Assistant Examiner*—Joan J. Figueroa
*Attorney, Agent, or Firm*—Alston & Bird LLP

[57] ABSTRACT

A sleeve label is fabricated from a sheet of polyethylene which is folded upon itself along two longitudinal fold lines with the overlying layers then being joined together along a seal line. The seal line is located so that the outer layer of the folded sheet forms an outer flap, which may be adhered to the body of the sleeve by a releasable adhesive strip. The outer flap can be printed to comprise a redeemable coupon, or it may be printed with detailed product information, or it may be configured to serve as a handle for the product. The label may also include a tubular header of small diameter, which can also serve as a coupon, or be printed with detailed product information, or configured to serve as a handle.

15 Claims, 4 Drawing Sheets

19
20
36
16
14
18

32
36
20
22
26
24

22
20
26
24

42
12
42
22
12
35
42
40
20
12
34

22
42
42
40
20
42
12
20
40
22
30

SLEEVE LABEL WITH INTEGRAL FLAP AND/OR HEADER

BACKGROUND OF THE INVENTION

The present invention relates to a tubular sleeve of polymeric film which is adapted for use as a sleeve label on a consumer product.

Many consumer products, such as plastic bottles and jugs, are directly printed with an identifying label and product information. However, it is difficult and costly to achieve high quality printing on such products, particularly in instances where it is necessary to utilize small print in order to provide detailed product information in a relatively small space.

As an alternative to direct printing, sleeve labels have become increasingly popular, since the plastic material of the sleeve can be more easily printed in a high quality manner, thus improving the attractiveness of the product to the consumer. Also, more product information can be supplied in a relatively small space because of the higher print quality.

Sleeve labels are fabricated by a process wherein a sheet of suitable polymeric material, usually low density polyethylene, is initially printed with the desired product identifying and descriptive information. The sheet is then advanced along a longitudinal path of travel, and it is folded upon itself so that the two side edges of the sheet overlie each other. The overlying side edges are then sealed together along a heated weld line or the like to form a tube. Also, transverse perforated tear lines are formed in the tube at longitudinal spaced apart locations so as to define the individual labels. The tube is then positioned above the consumer product, such as a bottle or package, and the gripper arms of an assembly machine reach into the tube to radially expand the lowermost label and pull it downwardly so as to separate it from the remainder of the tube along the transverse tear line. The gripped label is then brought into surrounding relation about the consumer product, and the gripper arms release the expanded label so that it contracts and is applied to the product.

It is an object of the present invention to provide an improved sleeve label of the described type, as well as to provide an improved method of fabricating the same.

It is a more particular object of the present invention to provide an improved sleeve label having an outer flap which is an integral part of the label, and which can be used to provide additional product information, or as a redeemable savings coupon for use by the consumer, or as a product handle.

It is also an object of one particular embodiment of the invention to provide a sleeve label of the described type which includes a small tubular header which is an integral part of the sleeve label, and which can be used for the above purposes as well as for supporting a coupon or informational card for use by the consumer.

SUMMARY OF THE INVENTION

The above and other objects and advantages of the present invention are achieved in the embodiments illustrated herein by the provision of a tubular sleeve which comprises a sheet of polymeric material which is folded upon itself along two parallel longitudinal fold lines which are transversely spaced apart, and so as to define a medial portion located between the two fold lines which is composed of three layers of the sheet. A seal line is formed longitudinally along the medial portion of the folded sheet to interconnect the three layers and thereby define a first tubular portion on one side of the seal line and a second tubular portion on the other side of the seal line.

The folded sheet preferably also comprises an outer flap which extends from the seal line in a transverse direction so as to overlie at least a portion of the first tubular portion and so as to terminate in a longitudinal edge which is transversely spaced from the seal line. The outer flap may be printed so as to comprise a redeemable coupon for use by the consumer of the product to which the label is applied, and for this purpose a longitudinal perforated tear line may be provided in the outer flap and which extends parallel to and adjacent the seal line so that the outer flap may be manually separated from the remainder of the folded sheet. Preferably, an adhesive strip is provided for releasably adhering the longitudinal edge of the outer flap to the first tubular portion of the folded sheet. Rather than being a coupon, the outer flap can be printed with detailed product information, or it could also be configured to serve as a handle for the product.

The second tubular portion is of much smaller circumferential size as compared to the first tubular portion, and in one embodiment, the second tubular portion is severed from the remainder of the label concurrently with the formation of the seal line, and it is discarded. In other embodiments, the second tubular portion remains as an integral part of the sleeve label and forms what is referred to herein as a tubular header. The tubular header may also be separable by means of one or more perforated tear lines, and it can serve a number of functions, including a redeemable coupon, or as a location for additional printed information regarding the product, or as a handle.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
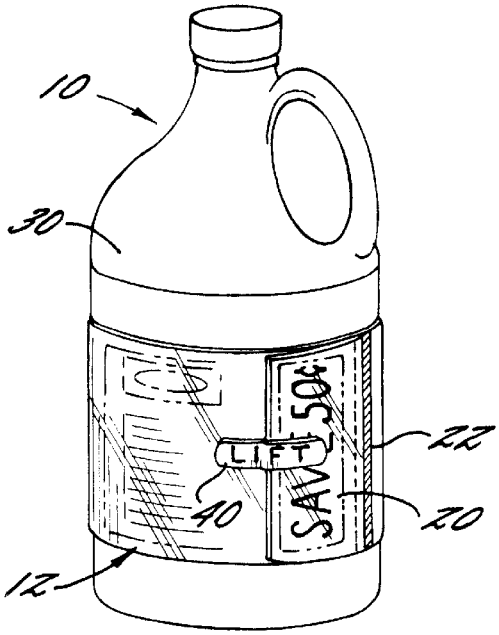
FIG. 1 is a perspective view of a consumer product which comprises a bottle having a sleeve label applied thereto which embodies the present invention.

Referring more particularly to the drawings, FIG. 1 illustrates a consumer product in the form of a gallon size plastic bottle or jug 10 which has applied thereto a sleeve label 12 which embodies the present invention. As will be understood as the description proceeds, the sleeve label 12 of the present invention may be applied to a large variety of other consumer products, such as drink sized cans, or rectangular boxes.

Figure 4:
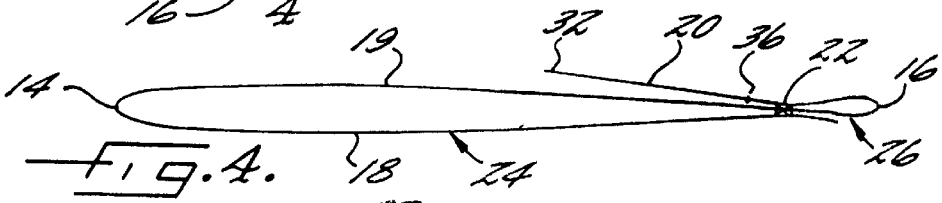
FIG. 4 is a cross-sectional view of the sleeve label taken substantially along the line 4—4 of FIG. 3.

The label 12 comprises a sheet of polymeric material, such as low density polyethylene, which is folded upon itself along two parallel longitudinal fold lines 14, 16 which are transversely spaced apart, and so as to define a medial portion located between the two fold lines which is composed of three layers of the sheet. The three layers comprise a back panel 18, a front panel 19, and an outer flap 20. A seal line 22 extends longitudinally along the medial portion of the folded sheet to interconnect the three layers and thereby define a first tubular portion 24 on one side of the seal line 22 and a second tubular portion 26 on the other side of the seal line 22. As best seen in FIG. 4, the first tubular portion 24 is of substantially greater circumferential size than the second tubular portion 26, and such that the first tubular portion is adapted to be assembled about the consumer product 30.

Figure 2:
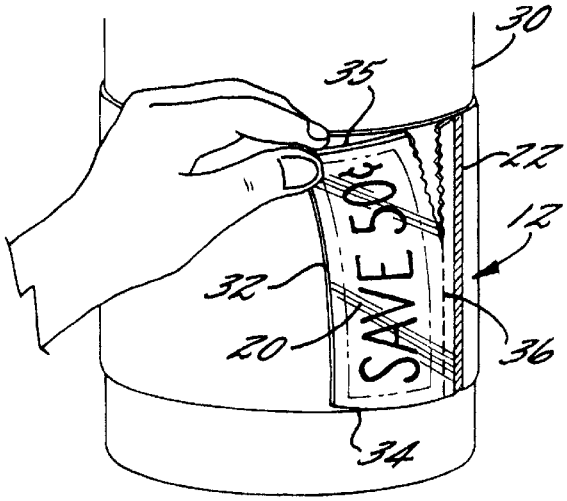
FIG. 2 is a fragmentary view of the product shown in FIG. 1 and illustrating the manner in which the outer flap may be removed from the product.
Figure 3:
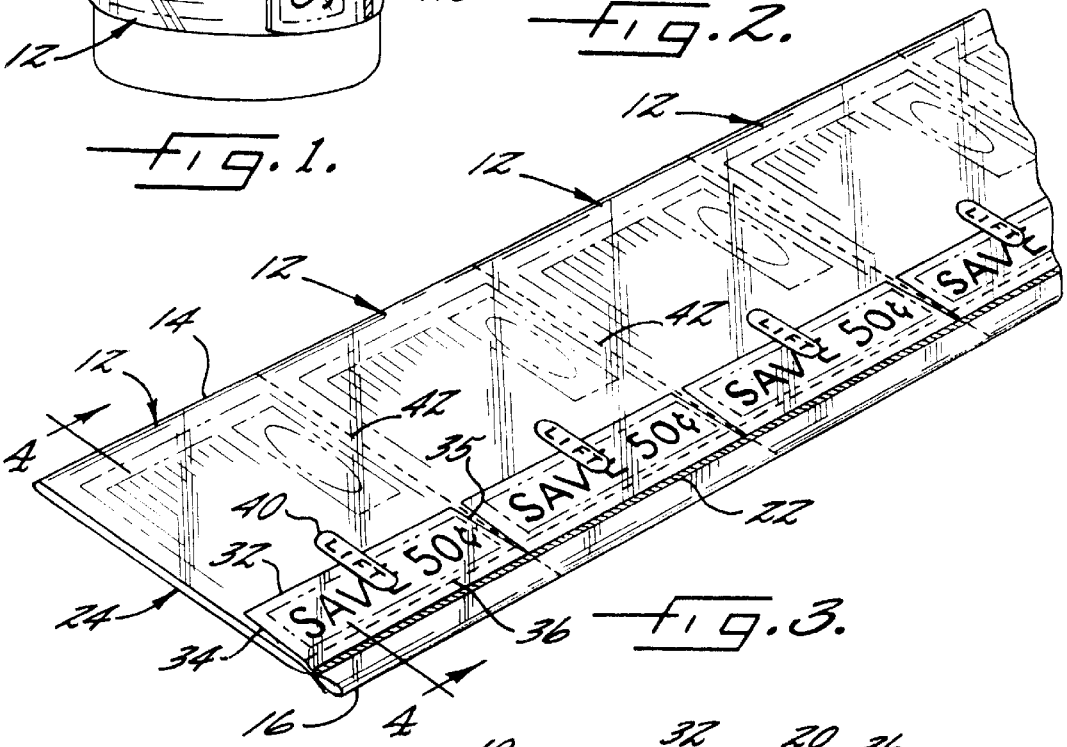
FIG. 3 is a perspective view of a plurality of sleeve labels at an intermediate stage of their fabrication and prior to being assembled to the consumer product.

The folded outer layer of the sheet which comprises the outer flap 20 extends from the seal line in a transverse direction so as to overlie a substantial portion of the first tubular portion 24, and the outer flap 20 terminates in a longitudinal free edge 32 which is transversely spaced from the seal line 22. Also, for the reasons explained below, the outer flap 20 includes opposite side edges 34, 35 which are in the form of continuous cuts, as opposed to perforated tear lines. Specifically, the opposite side edges 34, 35 comprise continuous cuts which are inclined toward each other so that the outer flap 20 has a diminishing longitudinal width in a direction moving away from the seal line 22. In addition, a longitudinal perforated tear line 36 is provided in the outer flap 20 which extends parallel to and adjacent the seal line 22 so that the outer flap may be manually separated from the remainder of the folded sheet in the manner illustrated in FIG. 2. Preferably, an adhesive strip 40 is also provided for releasably adhering the longitudinal edge of the outer flap to the first tubular portion of the folded sheet.

Figure 5:
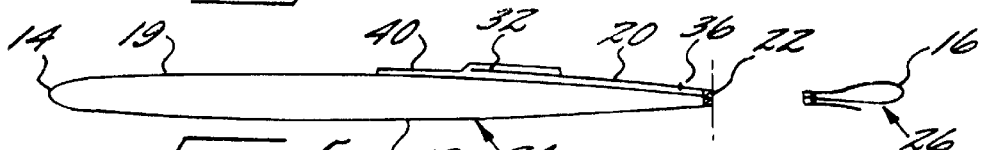
FIG. 5 is a view similar to FIG. 4 and illustrating the sleeve label at a subsequent stage of the fabrication process.

In its final configuration, the second tubular portion 26 is severed from the remainder of the folded sheet, so as to form a scrap segment which is discarded, note FIG. 5. The first tubular portion is then expanded and assembled onto the consumer product as described in more detail below.

Figures 6A, 6B, 6C, 6D, 6E:
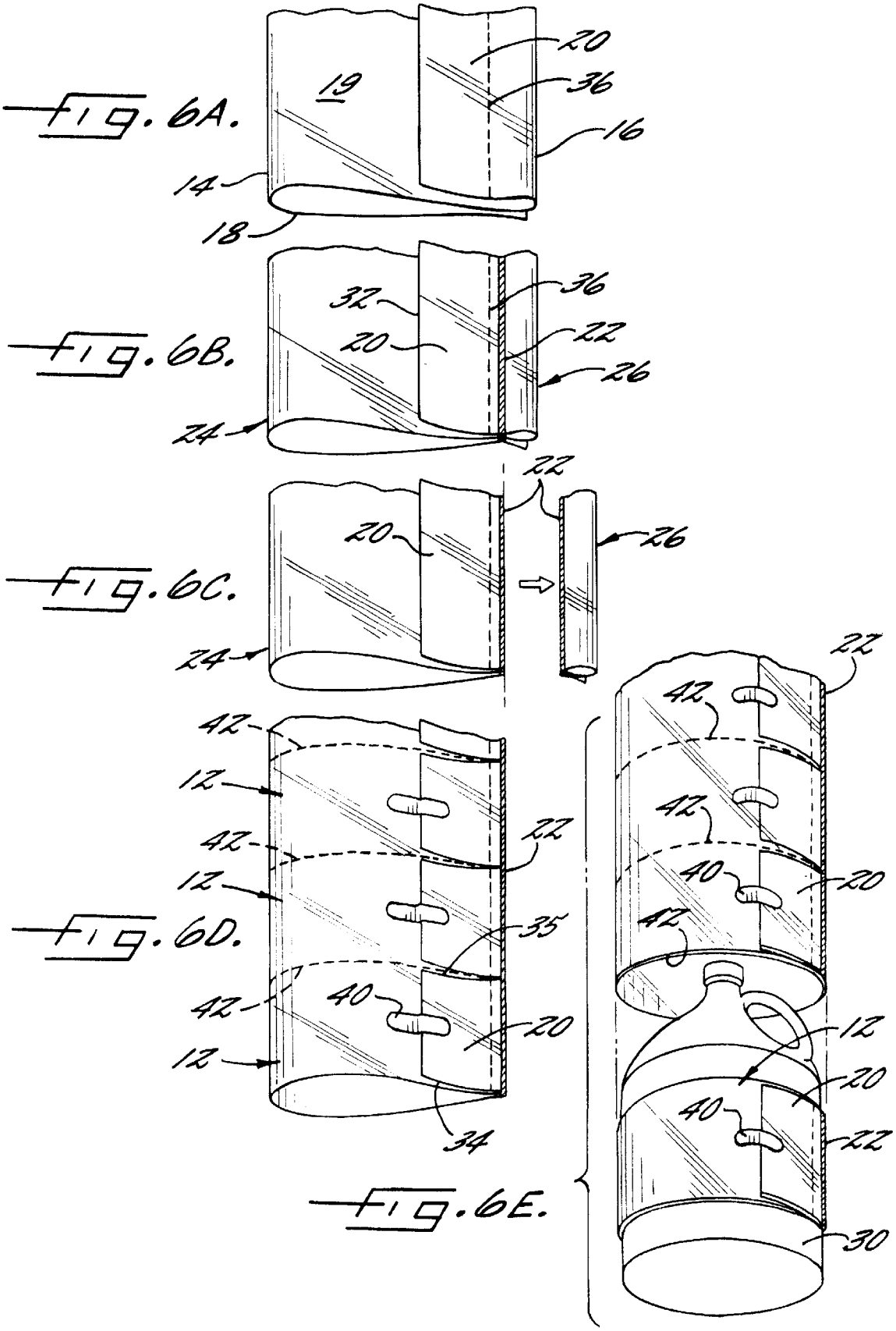
FIGS. 6A–6E are fragmentary perspective views illustrating the method of fabricating the sleeve labels and applying the labels to respective consumer products, in accordance with the present invention.

FIGS. 6A–6E schematically illustrate in more detail the sequence of steps involved in fabricating the sleeve label 12 and applying it to a gallon jug 30. As illustrated in FIG. 6A, a sheet of polymeric film, which has been printed on one surface with the desired product information, is advanced longitudinally and is folded upon itself along two parallel longitudinal fold lines 14, 16, so as to define a back panel 18, a front panel 19, and an outer flap 20 which overlies the front panel 19 and which terminates in a free longitudinal edge 32. In this regard, it will be noted that the direction of fold along the second fold line 16 is opposite the direction of fold along the first fold line 14. Also, as seen in FIG. 6A, a perforated longitudinal tear line 36 is formed in the sheet prior to the formation of the second fold 16.

The back panel 18, front panel 19, and outer flap 20 are secured together along a seal line 22 that is parallel to and adjacent the second fold line 16, and so as to define a first tubular portion 24 to the left of the seal line as seen in FIG. 6B and a second smaller tubular portion 26 to the right of the seal line. In the illustrated embodiment, the seal line 22 is formed by a heated weld, which serves to sever the second tubular portion 26 from the remainder of the folded sheet, and which is discarded, note FIG. 6C.

As illustrated in FIG. 6D, the advancing tube is next perforated along a plurality of longitudinally spaced apart transverse tear lines 42, which define the individual labels 12. Also, the outer flap 20 of each label 12 is trimmed by means of a continuous cut so that the flaps of adjacent labels are totally disconnected from each other. Preferably, the continuous cut is in the form of a shallow V shaped notch, so that the opposite side edges 34, 35 of each flap are inclined toward each other so as to have a diminishing longitudinal width in a direction moving away from the seal line.

The final manufacturing steps are illustrated in FIG. 6E wherein the tube is aligned above the consumer product, and the lowermost label 12 is gripped by the internal gripping arms of an assembly machine (not shown) which serves to radially expand and tear the lowermost label from the tube along the transverse perforated tear line 42 which is immediately above the lowermost label. The separated label 12 is then drawn down to surround the product 30 and is released, so that it contracts and is assembled onto the product. Heat may be applied to facilitate the contraction of the label, as is conventional.

The adhesive strip 40 may be applied to secure the outer flap 20 onto the tube prior to assembly of the sleeve label onto the product as illustrated, or the strip may be applied after such assembly.

The presence of the trimmed side edges 34, 35 of the outer flaps 20 on the tube as seen in FIG. 6D helps facilitate the uniform tearing of the lowermost label from the tube as it is joined to the product. More particularly, if the side edges 34, 35 were defined by the transverse perforated tear lines 42 rather than by continuous cuts, the tear-off operation would involve tearing through three layers on the right side portion of the tube as seen in FIGS. 6A–6E, and tearing through only two layers on the left side portion. This would result in a non-uniform resistance to the downward pull exerted by the assembly machine, which could in turn result in a skewing of the separated label as it is applied to the product. The fact that the flaps 20 of adjacent labels are separated by continuous cuts rather than a perforated tear line, avoids this problem.

As an alternative to the use of an adhesive strip 40, other means may be employed to releasably adhere the outer flap to the top panel 19, such as a narrow strip of releasable adhesive between the front panel and the outer flap, or a mechanically generated charge of static electricity.

The fact that the outer flap 20 is folded back upon the front panel 19 in a direction opposite the first fold line 14, provides an advantage when all printing is applied to only one surface of the sheet, as is conventional. In such case, the printing would normally be on the outside of the back and front panels, and on the underside of the outer flap. The position of the printing on the underside of the outer flap is desirable to avoid its rubbing off during transport or use of the product, and in addition, a secret prize number or other information could be printed on the underside of the outer flap which is not visible to the consumer until the product is purchased and the adhesive strip 40 is removed.

FIGS. 7–10 illustrate a second embodiment of the invention wherein the second tubular portion 26 forms a header which remains to form an integral part of the final sleeve label. More particularly, the header 26 includes a longitudinal perforated tear line 46, 47 on each side of the seal line 22 and so that the header may be separated in the form of a single sheet, note FIG. 10. The header 26 may be printed as a redeemable coupon which can be separated by the consumer, thus providing a means for including two removable coupons on the sleeve label, namely the outer flap 20 and the header 26. Alternatively, the header 26 could be printed with additional product information, or it could include an opening (not shown) which would facilitate its use as a handle for the product.

In the embodiment of FIGS. 7–10, the front panel 19 has an end portion 19*a* which extends into the header 26 and which provides space for printing additional product information, which is visible when the header is removed. Alternatively, the end portion 19*a* could be designed as a third coupon which could be removed along a tear line (not shown).

Figure 7:
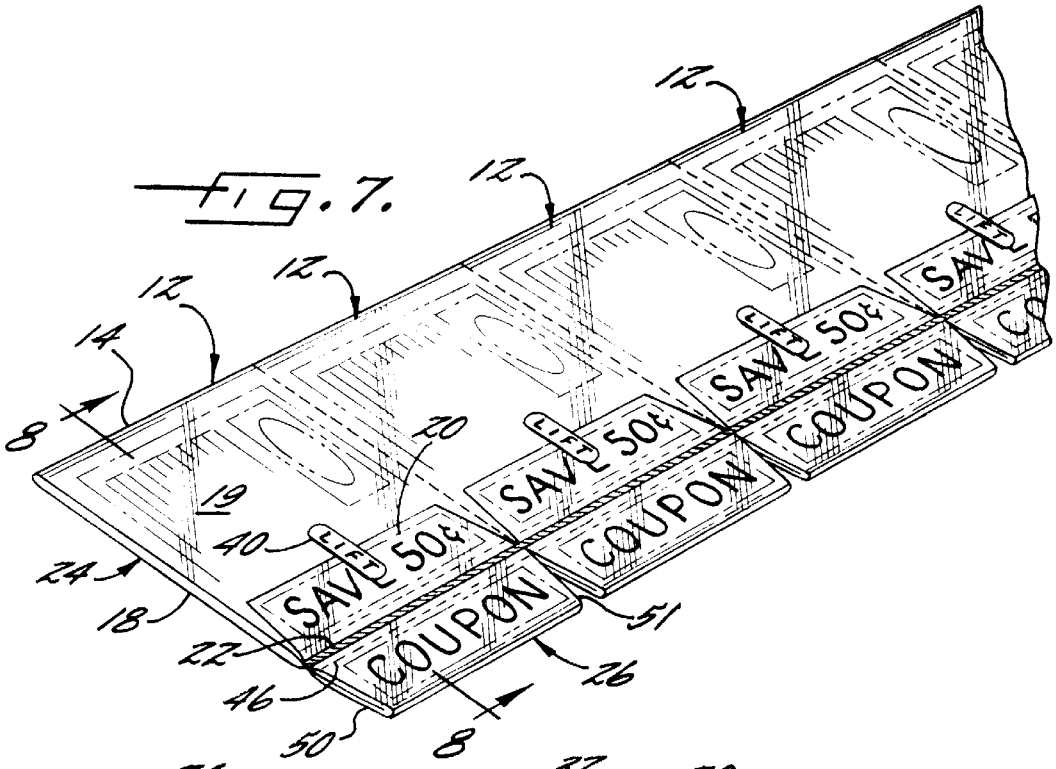
FIGS. 7 and 8 are views similar to FIGS. 3 and 4 respectively, and illustrating a second embodiment of the invention.
Figure 8:
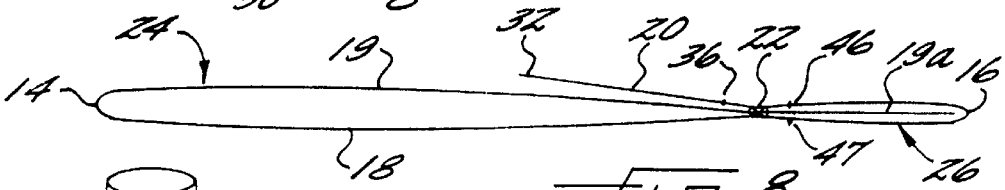
Figure 9:
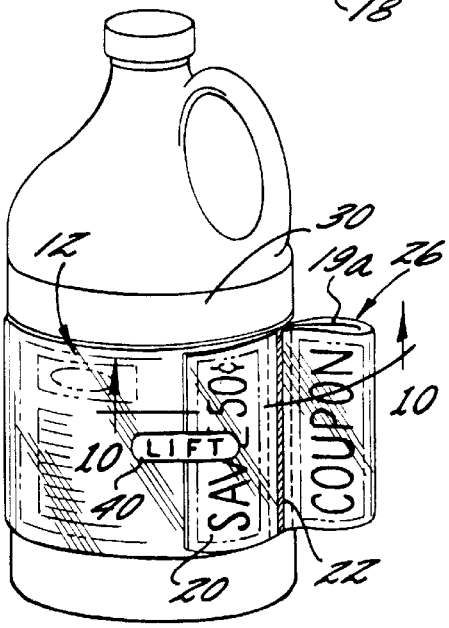
FIG. 9 is a view similar to FIG. 1 and illustrating the embodiment of the sleeve label shown in FIGS. 7 and 8 applied to a product.
Figure 10:
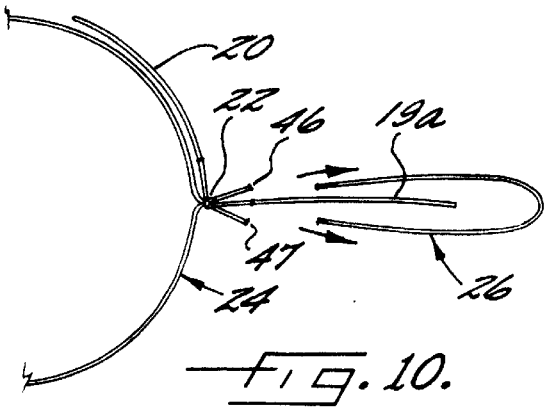
FIG. 10 is a fragmentary sectional view illustrating the manner in which the second tubular portion or header may be separated from the remainder of the sleeve label.
Figure 11:
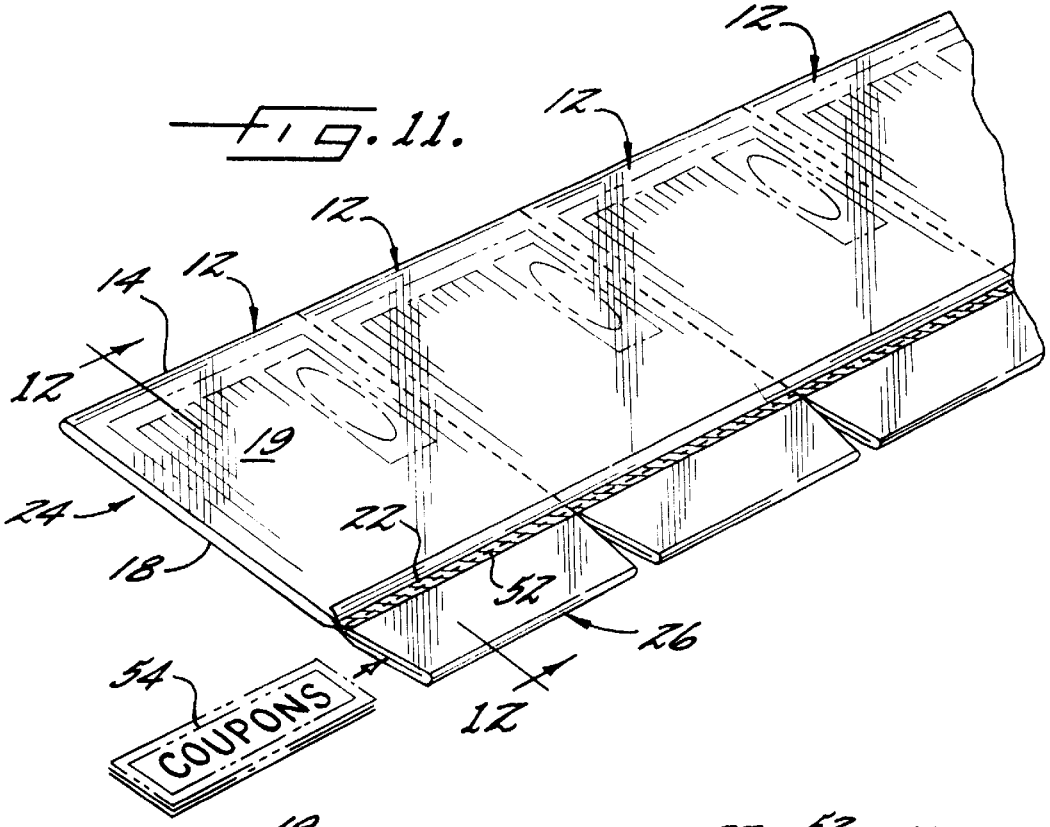
FIGS. 11–14 correspond respectively to FIGS. 7–10 and illustrate a further embodiment of the invention.
Figure 12:
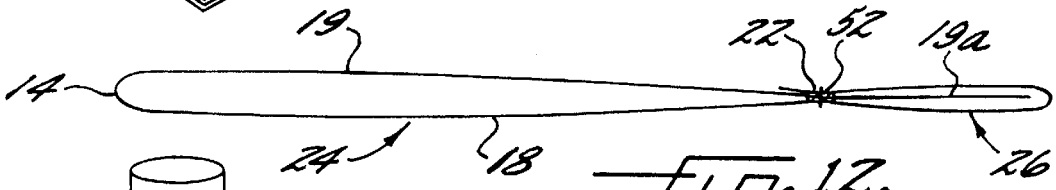
Figure 13:
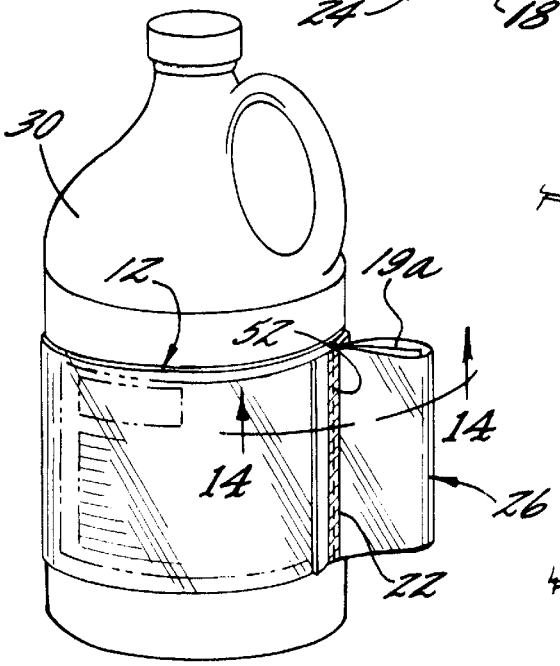

The header 26 of each label 20 includes opposite edges 50, 51 which are formed by continuous cuts, which as illustrated in FIG. 7 comprise V-shaped notches between adjacent labels on the tube. These continuous cuts, which are also formed on the end portion 19*a* of the front panel, serve to prevent skewing of the label as it is applied to the product for the reasons explained above with respect to the side edges of the outer flaps.

Figure 14:
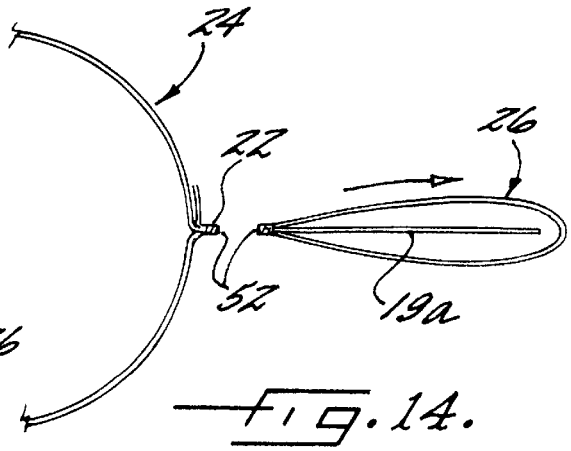

FIGS. 11–14 illustrate another embodiment of the invention which does not include an outer flap, and wherein the seal line 22 is perforated along a tear line 52 which is aligned along the middle of the seal line, so that the header 26 and the end portion 19*a* may be removed as a unit, i.e., in the form of a tube, note FIG. 14. Further, the header 26 may be designed to receive one or more coupon cards 54, or a folded sheet which could contain several printed coupons or detailed product information.

That which is claimed is:

1. A tubular sleeve adapted for use as a sleeve label for a consumer product, comprising a sheet of polymeric material which is folded upon itself along two parallel longitudinal fold lines which are transversely spaced apart, and so as to define a medial portion located between the two fold lines which is composed of three layers of the sheet over at least a portion of the medial portion, and a seal line extending longitudinally along the medial portion of the folded sheet and intermediate the two fold lines to interconnect the three layers and thereby define a first tubular portion on one side of the seal line and a second tubular portion on the other side of the seal line.

2. The tubular sleeve as defined in claim 1 wherein one of the layers forms an outer flap which extends from the seal line in a transverse direction so as to overlie at least a portion of the first tubular portion and so as to terminate in a longitudinal edge which is transversely spaced from the seal line.

3. The tubular sleeve as defined in claim 2 wherein said outer flap includes opposite side edges which are formed by continuous cuts.

4. The tubular sleeve as defined in claim 3 wherein the second tubular portion includes opposite side edges which are formed by continuous cuts.

5. The tubular sleeve as defined in claim 2 further comprising a longitudinal perforated tear line in said outer flap and which extends parallel to and adjacent said seal line so that the outer flap may be manually separated from the remainder of the folded sheet.

6. The tubular sleeve as defined in claim 5 further comprising means for releasably adhering the longitudinal edge of the outer flap to the first tubular portion of the folded sheet.

7. The tubular sleeve as defined in claim 1 wherein the first tubular portion is of substantially greater circumferential size than the second tubular portion and such that the first tubular portion is adapted to be assembled about a consumer product.

8. The tubular sleeve as defined in claim 7 wherein the second tubular portion includes a longitudinal perforated tear line on each side of the seal line and so that the second tubular portion may be separated in the form of a single sheet.

9. The tubular sleeve as defined in claim 7 wherein a longitudinal perforated tear line extends along the middle of the seal line and so that the second tubular portion may be separated in the form of a tube.

10. The tubular sleeve as defined in claim 7 further comprising a printed card or sheet received in said second tubular portion.

11. The tubular sleeve as defined in claim 1 wherein the two longitudinal fold lines are folded in opposite directions.

12. An elongate tubular member composed of a plurality of serially arranged tubular sleeves, with each of said tubular sleeves comprising:

a sheet of polymeric material which is folded upon itself along a longitudinal fold line to define a back panel and a front panel, said back panel and said front panel being secured together along a seal line which is parallel to and transversely spaced from said longitudinal fold line so as to define a tube, and an outer flap secured to and extending from the seal line in a transverse direction so as to overlie at least a portion of the front panel and terminating in a longitudinal edge which is transversely spaced from said seal line, said front and back panels of each of said tubular sleeves having opposite side edges which are joined to the side edges of the front and back panels respectively of the adjacent tubular sleeves by a perforated tear line, and said outer flap of each of said tubular sleeves having opposite side edges which are at least substantially separated from the side edges of the outer flaps of the adjacent tubular sleeves so as to facilitate the separation of the tubular sleeves by sequentially tearing the end-most tubular sleeve from the tubular member.

13. The elongated tubular member as defined in claim 12 wherein said opposite side edges of said outer flap of each of said tubular sleeves are formed by continuous cuts.

14. The elongated tubular member as defined in claim 12 further comprising a longitudinal perforated tear line in the outer flap of each of said tubular sleeves at a location immediately adjacent the seal line so as to permit the outer flap to be readily separated from the remainder of the tubular sleeve.

15. The elongated tubular member as defined in claim 12 further comprising means for releasable adhering the longitudinal edge of the outer flap of each of said tubular sleeves to the front panel thereof.

* * * * *

UNITED STATES PATENT AND TRADEMARK OFFICE

CERTIFICATE OF CORRECTION

PATENT NO. : 6,129,959

DATED : October 10, 2000

INVENTOR(S) : Mercer et al.

It is certified that error appears in the above-identified patent and that said Letters Patent is hereby corrected as shown below:

Column 6, lines 52, 55 and 61, "elongated", each occurrence, should read --elongate--.

Signed and Sealed this

Eighth Day of May, 2001

*Attest:*

Nicholas P. Godici

NICHOLAS P. GODICI

*Attesting Officer*

*Acting Director of the United States Patent and Trademark Office*